US008156939B1

(12) United States Patent
Maddalena

(10) Patent No.: US 8,156,939 B1
(45) Date of Patent: Apr. 17, 2012

(54) THERAPEUTIC PRESSURE PILLOW APPARATUS

(76) Inventor: Rachael Joelle Maddalena, Claremont, CA (US)

( * ) Notice: Subject to any disclaimer, the term of this patent is extended or adjusted under 35 U.S.C. 154(b) by 216 days.

(21) Appl. No.: 12/380,202

(22) Filed: Feb. 26, 2009

Related U.S. Application Data

(60) Provisional application No. 61/126,054, filed on May 1, 2008.

(51) Int. Cl.

| | |
|---|---|
| ***A61G 15/00*** | (2006.01) |
| ***B68G 5/00*** | (2006.01) |
| ***A61H 1/00*** | (2006.01) |
| ***A61H 7/00*** | (2006.01) |

(52) U.S. Cl. ..... 128/845; 5/655.3; 5/655.5; 601/49; 601/132

(58) Field of Classification Search ..... 128/845, 128/873, 875; 5/644, 645, 655.3, 655.5; 601/57, 49, 84, 85, 132, 46, 48, 55, 61, 64, 601/65, 75, 105, 148–150
See application file for complete search history.

(56) References Cited

U.S. PATENT DOCUMENTS

| | | | | |
|---|---|---|---|---|
| 1,353,260 | A * | 9/1920 | Monks | 5/659 |
| 4,750,224 | A * | 6/1988 | Stracke | 5/655.3 |
| 5,545,456 | A * | 8/1996 | Suida | 428/76 |
| 6,007,501 | A * | 12/1999 | Cabados et al. | 601/15 |
| 6,024,762 | A * | 2/2000 | Gray | 607/109 |
| 6,174,297 | B1 * | 1/2001 | Chen | 601/128 |
| 6,182,313 | B1 * | 2/2001 | Eschenbach | 5/640 |
| 7,811,241 | B1 * | 10/2010 | Baker | 601/131 |
| 2003/0144616 | A1 * | 7/2003 | Henderson | 601/131 |
| 2006/0289585 | A1 * | 12/2006 | Godshaw et al. | 224/625 |
| 2007/0055187 | A1 * | 3/2007 | Magnone et al. | 601/132 |

* cited by examiner

*Primary Examiner* — Ehud Gartenberg
*Assistant Examiner* — George N Phillips
(74) *Attorney, Agent, or Firm* — William W. Haefliger

(57) ABSTRACT

In therapeutic apparatus, the combination comprising an adjustable cradle pressure exerting therapeutic cushion, a flexible sheath housing a cushion, an elongated support operatively connected to a sheath for maneuvering a sheath and cushion into selected position or positions for transmitting pressure between a person and a surface onto which a person's body weight is imposed via a cushion and sheath.

16 Claims, 5 Drawing Sheets pouch or sheath concave surface of 16
sideward facing extents (dimensions) of zone 16
10
18
11
14
19
13
12
120'
185
180
11a
16
183
184
12a
21
20
sideward facing extent of 12
sideward facing extent of globular element 11
mid-region or zone
concave surface of 16
23
22

THERAPEUTIC PRESSURE PILLOW APPARATUS

This application claims priority from provisional application Ser. No. 61/126,054, filed May 1, 2008.

BACKGROUND OF THE INVENTION

This invention relates generally to local pressure producing therapeutic apparatus, and more particularly to easily adjustable cushion or pillow apparatus providing multiple benefits as respects structure, function and useful results when controllably applied to the human body. The invention provides controllable means for applying pressure to soft tissues, at various locations on the human body, by controlling the placement, orientation and adjustment of pressure points to be described.

Long history of human experience and medical data, demonstrate that many medical problems associated with soft tissues, and organs are exacerbated by restricted blood flow. Restrictions in blood flow result from many conditions experienced by people, such as over exertion, trauma, stress and other external factors. These soft tissues and organs include the brain and as such, issues such as headaches with particular emphasis on migraine headaches, are suffered by many millions of people, worldwide.

Pressure applied in localized areas of soft tissues, and other deep massage applications are demonstrative of increasing blood flow, creating conditions in soft tissues allowing the inter connective tissue boundaries, and other elements, to elongate. The effects of this localized and specifically controlled pressure in applications of fixed or variable time used, preferably but not limited to times of pressure, induce in the tissues an elongation and relaxation, that cycles the blood pressure in localized regions in the soft tissues resulting in a natural augmentation of function.

The use of massage techniques require therapists or other persons. There is need for simple, compact means to automatically apply variable pressure, without requiring a massage therapist.

There is also need for simple effective treatment of muscle groups such as, but not limited to, areas of the scapula, trunk, and shoulders which are particularly vulnerable to constriction from normal activities such as the act of typing. Muscle groups such as, but not limited to, Rhomboid minor, and Rhomboid major, Trapezius, and Levator Scapulae, respectively, are muscle groups needing treatment as by the present invention to effectively increase blood flow.

SUMMARY OF THE INVENTION

It is a major object of the invention to provide method and means to meet the above needs. Basically, and in apparatus aspects, the invention comprises:

a) adjustable cradle pressure exerting therapeutic cushion means, b) flexible sheath means housing the cushion means, c) elongated support means operatively connected to the sheath means for maneuvering the sheath means and cushion means into selected positions for adjustably transmitting pressure between a person and a surface onto which a person's body weight is imposed via the cushion means and sheath means.

As will be seen, the apparatus of the invention preferably includes cushion means in the form of two partially deformable, and relatively stiff globular elements individually shiftable in response to user pressure application.

Another object includes provision of sheath means in the form of sheath sections extending about the shiftable globular elements, and connecting said elements in the space therebetween, allowing the elements to relatively twist. As will be seen, those elements may advantageously include flexible enclosures filled with flowable material, allowing relative position shifting of the enclosure within the sheath structure.

A further object includes provision of strap means to include at least two elongated relatively narrow straps operatively connected to opposite ends of said sheath means, which is elongated between said ends.

As will be seen, the sheath means is preferably elongated and has a mid-portion extending between the globular elements to maintain relative shiftability thereof. The strap means is preferably attached to opposite ends of the sheath means to allow maximum shiftability thereof relative to the user's torso, and without strap interference with said shiftability.

The method of use of the improved, compact, self-adjustable apparatus includes:

i) positioning said sheath means in cradling relation adjacent the human body, by manipulation of said strap means, ii) allowing pressure exerted by the body to be transmitted via said sheath means and cushion means to a support surface, thereby locally and controllably pressurizing and deforming the body, by cradled pressure exertion.

The method may also include the step of periodically adjusting the position of the sheath means relative to the body.

The method may further include selecting and employing relatively different size dual cushion means, enclosed in said sheath means.

These and other objects and advantages of the invention, as well as the details of an illustrative embodiment, will be more fully understood from the following specification and drawings, in which:

DRAWING DESCRIPTION

Figure 1:
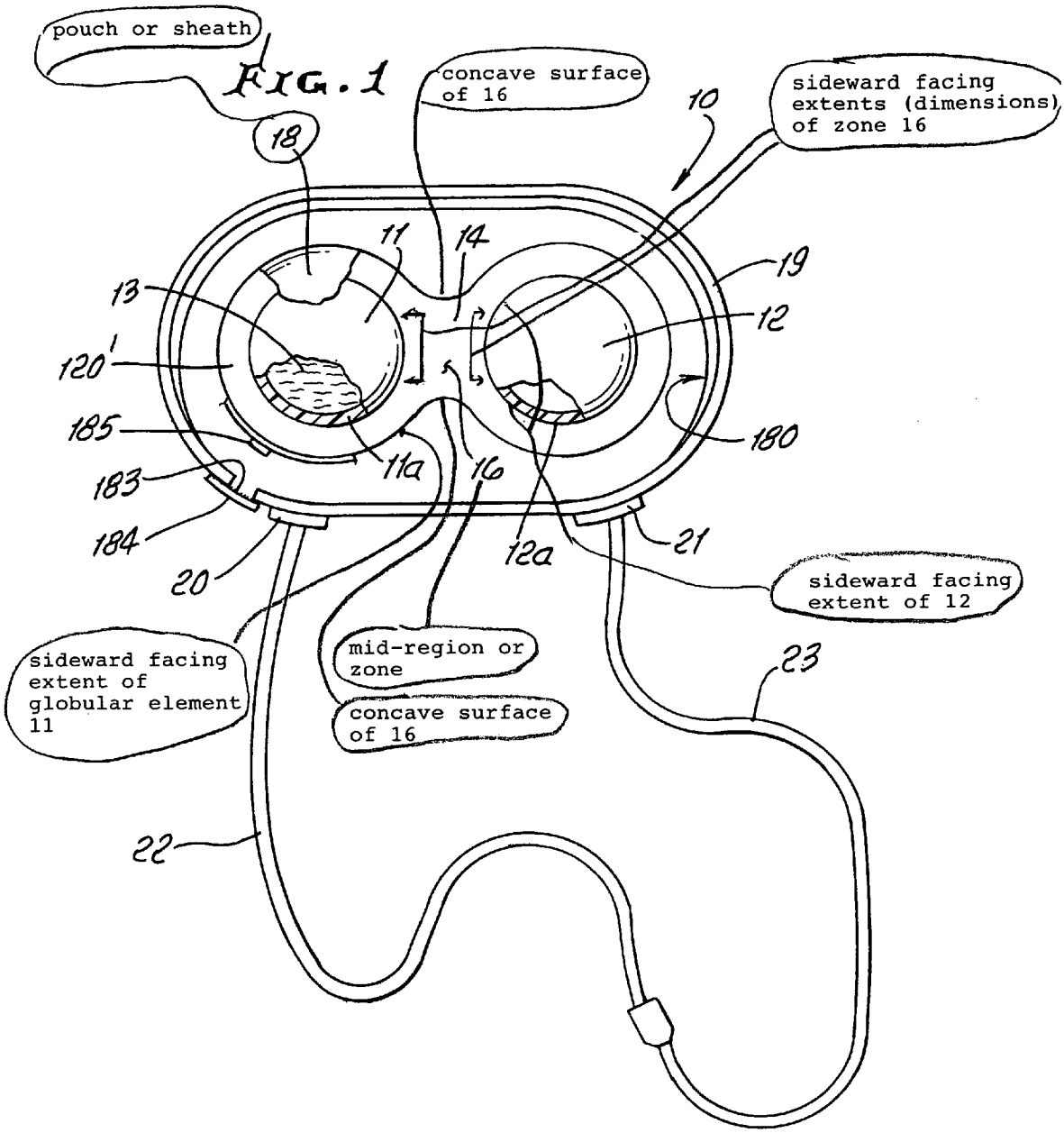
FIG. 1 is a front elevation of preferred apparatus incorporating the invention.
Figure 3A:
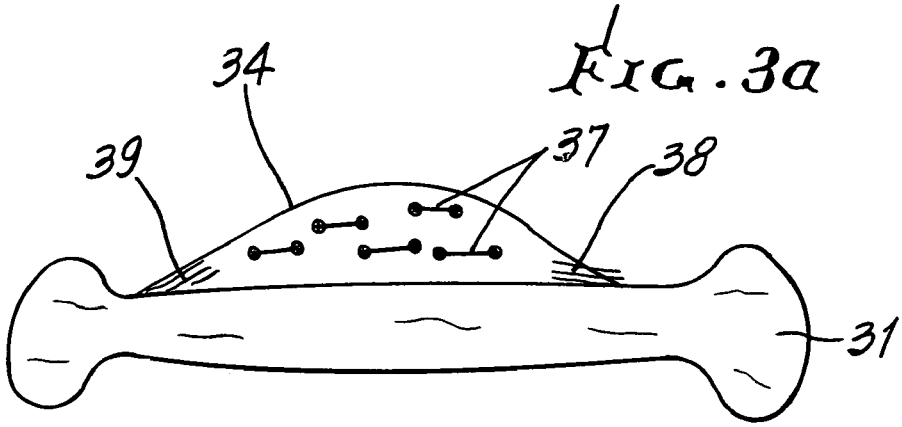
Figure 3B:
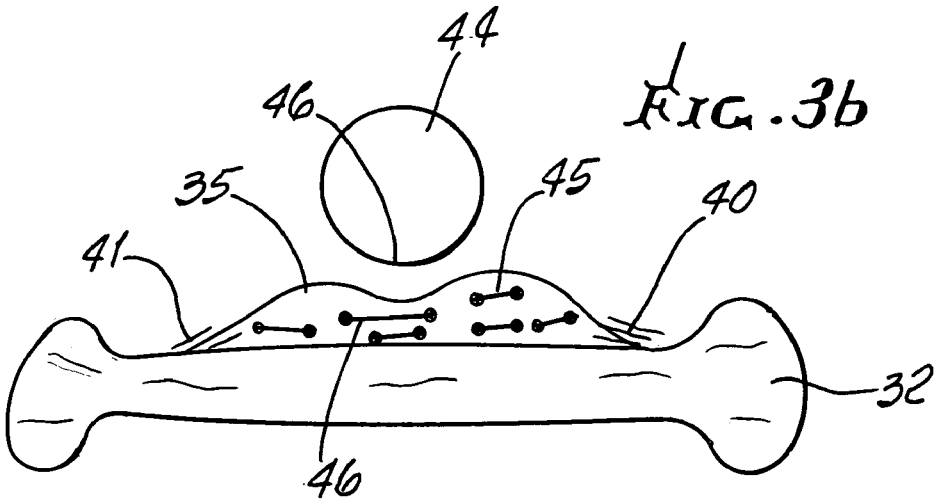
Figure 3C:
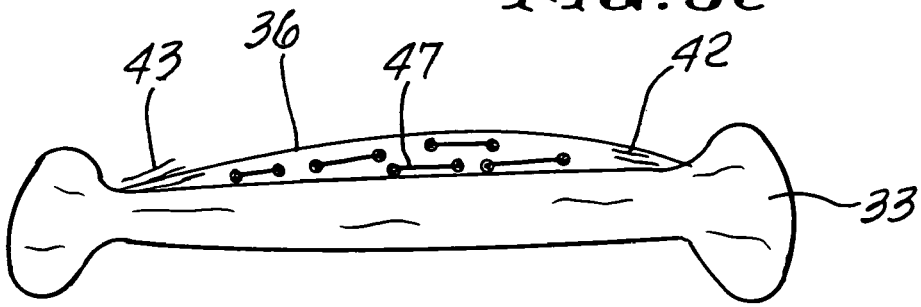
Figure 4:
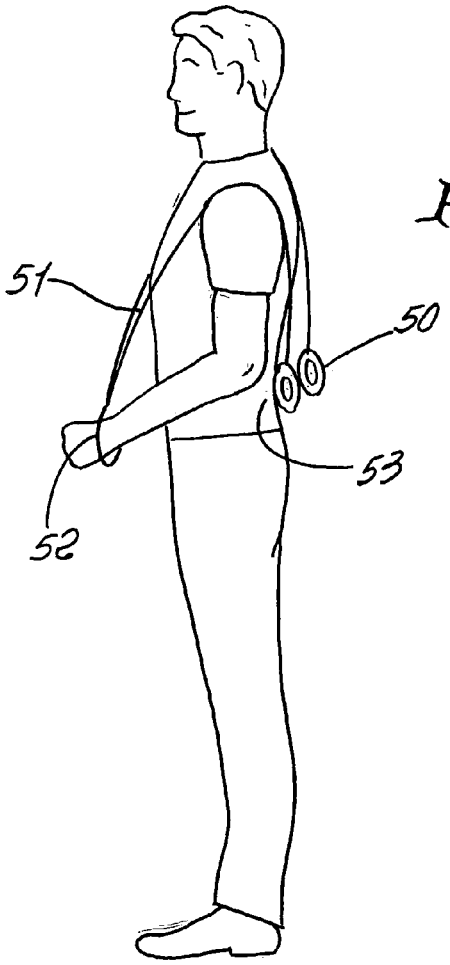
Figure 5A:
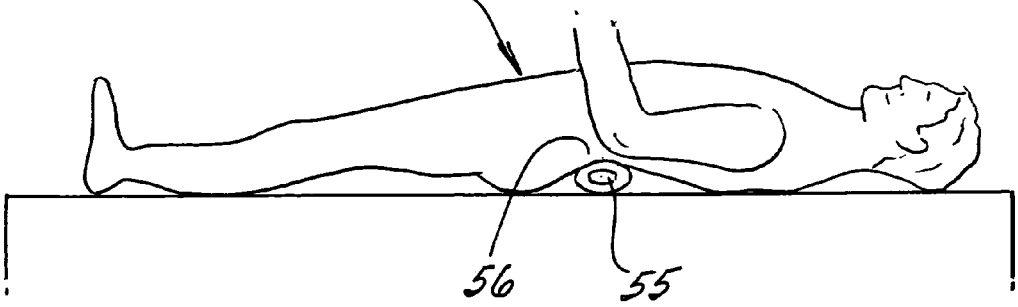
Figure 5B:
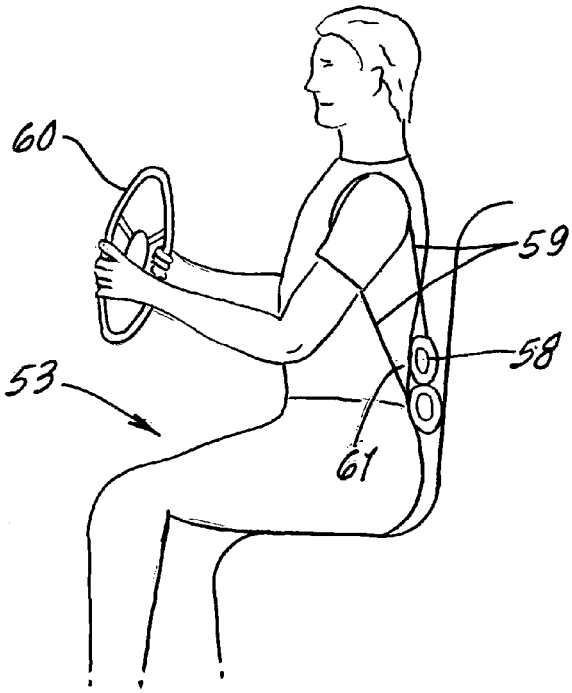
Figure 6A:
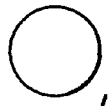
Figure 6B:
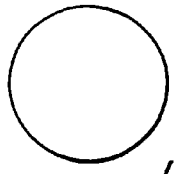
Figure 6C:
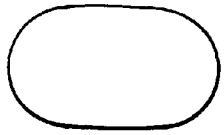
Figure 6D:
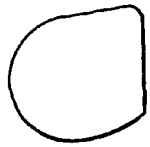

FIGS. 3*a*-3*c* show three states of pressure exertion;

FIG. 4 is an end view of the FIG. 1 apparatus, as positioned between a reclining user's back and an external surface; and FIGS. 5*a* and 5*b* are diagrams showing two different self-adjusted uses of the globular elements when positioned as in FIG. 4; and FIG. 6 shows different size and shape globular pressure elements.

DETAILED DESCRIPTION

A top view of the apparatus 10 shows basic elements. Globular elements 11 and 12 are spherical, but are not limited to this preferred embodiment, there being analogous shapes that provide the function of force transmitting interface with the human body. In use, cradled pressure exertion is created, by either weight of the human body against the apparatus that transfers pressure against some surface, or the weight of the apparatus that applies pressure to the human tissue.

Smooth or textured, the surfaces of the elements 11 and 12, are typically resiliently compressible, and can be varied by size, weight, geometry, and density. The pressure elements 11 and 12, can be inflated, or filled with materials such as gels, and/or water, to achieve the disclosed utility herein described.

Preferably, the enclosed flowable material 13 is housed within flexible enclosures 11*a* and 12*a* allowing limited deformation. A single pressure element, or multiple pressure elements are employed, with a preferred embodiment employing two, as shown. The elements 11 and 12 preferably are located a specific distance 14 apart, or close to one another. They are positioned spaced apart relative to one another to allow independent deflection or squeezing in response to variable pressure application, with the elements independently deformed in accordance with the contours of the human body, or clothed human body, being pressurized. The thin control membranes 11*a* and 12*a* enclosing the material 13 consist of fabric, plastic or other material, and can be semi-rigid, or flexible in construction. The control membranes 11*a* and 12*a* provide a sealed off zone at 16 between the pressure elements, and serve to exclude moisture and vibration, providing structural strength to maintain internal placement of enclosed material 13.

The pressure elements 11 and 12, enclosed in control sheath sections or membranes 11*a* and 12*a* are further enclosed in an adjustable outer pouch 18, acting as a further sheath and that consists of fabric, plastic or other flexible material operating as a pressure transmitting control that interfaces with the human user. A flexible housing 180 or outer sheath encloses pouch 18 having a surface layer 19 that is typically smooth, soft, fuzzy, or that has other texture that is flexible and interfaces conformingly in pressure transmitting relation between pressure elements and the human user. Flexible housing 180 is elongated and has convex ends. Note space 120 between 11*a* and 12*a* and 18; and space 121 between 18 and 180, allowing shifting of 11 and 12. Pouch 18 has a mid-region defining a sealed off zone having outwardly and oppositely facing concave surfaces between mid-portions of the pressure elements 11 and 12. An hourglass shape is formed The generally cylindrical, elongated housing 180 has fasteners 20 and 21, attached such that adjustment straps 22 and 23, can be affixed to the ends of 180, providing adjustability in strap length and deployment as when the housing dangles at the user's back. This utility of flexible straps provides a means of controlling the precise supported placement of the device adjacent the body or human tissue. The housing is equipped with an opening 183 that is securable at 184, as by VELCRO, and that provides for removal and replacement of elements 11 and 12 secured in 18, which may have a similar opening at 185. Such elements may be of different sizes and hardness as referred to. Removal of the pressure elements from 18 and 180 facilitates their cleaning, and provides for interchangeability of the pressure elements 11 and 12 to accommodate different sizes, textures, or densities of elements to exert selective and controlled pressure against specific areas of human soft tissues, and to accommodate different size users. Different size and shape globular elements are shown in FIGS. 6*a*-6*d*.

Figure 2:
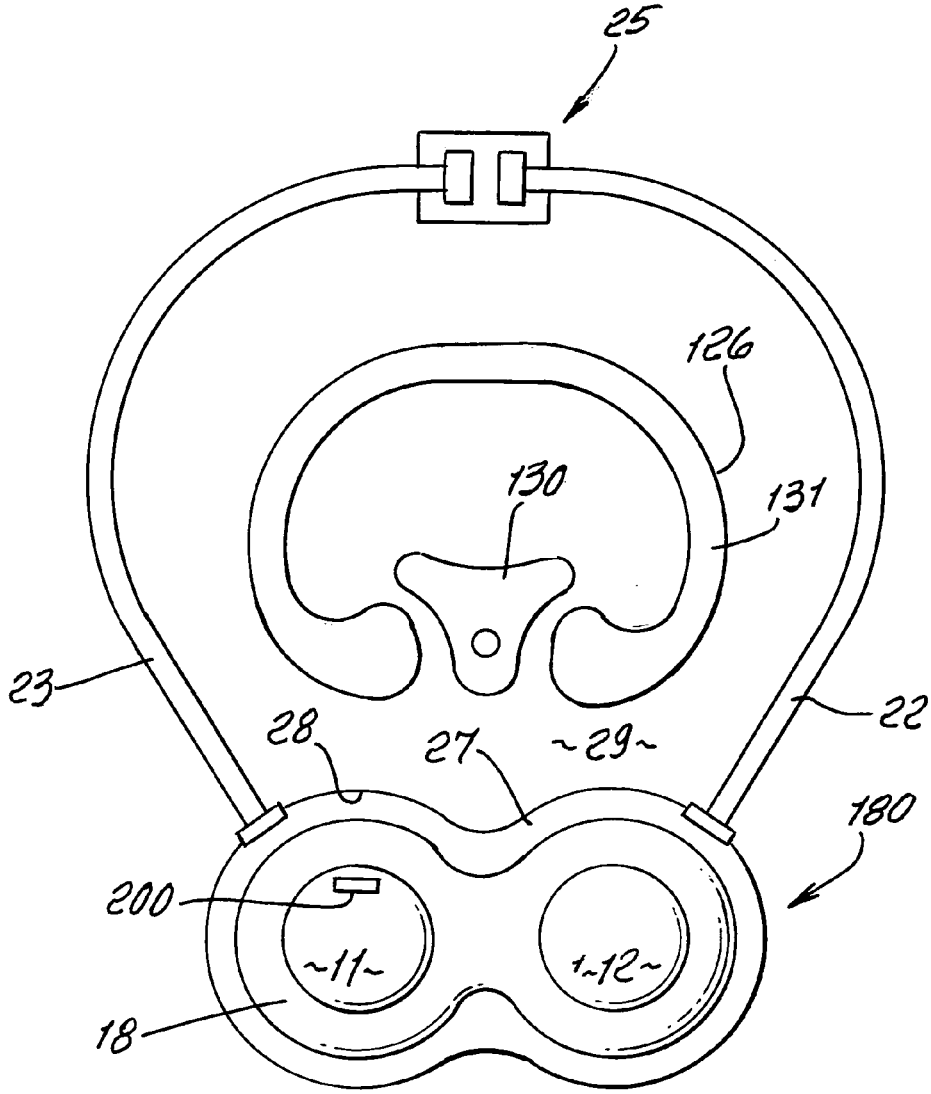
FIG. 2 is a view showing shiftability direction to self adjust pressure apparatus points.

A FIG. 2 top view shows orientation of pressure elements, to each other. From the top view the cervical vertebra is shown in element 130. The specific invention is shown with the control membrane 18 that keeps the pressure elements 11 and 12 in proper separation with independent amount of flex each pressure element, as in a static, and dynamic deployment where static pressure against the user's body can be adjusted, readjusted and applied as the user intends, with strap lengthening adjustment over the shoulders.

The outer containment housing in vessel 180 holds the control membrane 18, which in turn holds the pressure elements 11 and 12 and can be made with a multiplicity of surfaces ranging from very smooth, to textured and contoured. The outer housing protects the inside elements, and may be sealed, or unsealed allowing interchanging of 11, 12 and 18.

The pressure elements 11 and 12 can be multiple and not limited to one or two. The variable sizes and textures of the elements offer multiple utility in treating human tissue. Pressure elements 11 and 12 can be heated by boiling, microwaving, and other methods of heating, to hold thermal latent heat to be released as the present invention is being used.

Straps 22 and 23 that are attached to 180 terminate at adjustable connection 25. The user is able to adjust the lengths of the straps supporting 180 for precise orientation and level of the device against or with respect to human tissue to be treated.

The thoracic structure 131 indicated reflective side 126 is bounded by the straps. See also formed cervical vertebra 120. Surface 27 of 180 pressurizes thoracic element surface 28, as via flesh at 29. Such pressure exertion, described in FIG. 3*a*, shows an example of the multiplicity of locations, and soft tissues, including the limbs and head, the entire body to which the device of the invention can be applied for expanded utility. A vibrating component or means 200 is shown in 11, to induce vibratory pressurization of the user's tissue, with 11 and 12 pressing against 18 and 180, adjacent the user's tissue.

FIGS. 3*a*-3*c* side views show a progression of three states of sample soft tissue pressurized experience. Element 31 is a human, or animal, bone. Muscle tissue 37 is shown in a constricted state. Constriction is a normal example of soft tissue response to trauma. The surface shape of the muscle tissue group 34 is shown, as is depicted by connective tissue 38 and 39 on either side of muscle group 34.

In FIG. 3*b* device 44, representing the FIGS. 1 and 2 devices, is applied to the muscle group 35 responding to applied pressure at 44. The bone 32 holds connective tissue 40 and 41, on either side of the muscle group 35. The effect is to localize pressure, both static or moving, that elongates the individual muscle tissue, and human, or animal soft tissue 45 and 46, delivering a utility of elongation. The induced state of elongation changes constricted muscle soft tissue 45, into elongated soft tissue elements 146.

In FIG. 3*c*, bone 33 is shown holding connective tissue at 42 and 43, and intermediate soft tissue group at 36. The effect of use of pressure device 44 results in softer tissue shapes at 36, having a predominate amount of specific soft tissue elements 47 that are increasingly elongated relative to their shapes before the device 44 is applied.

FIG. 4 shows a standing human user 48 adjusting the straps of device 50, representing the FIG. 1 device, adjacent a location 53 of soft tissue at user's back. The adjustable straps 51 and 52, provide the user 48 manually controlled device location adjustability, as described above. Additional utility of orienting and controlling the device placement is provided.

FIG. 5*a* shows a reclining human user 54, with device 55 (as in FIGS. 1 and 2) placed such that the intended soft tissue 56 of the back is targeted for pressure application, provided by the natural weight of the user 54 pressing 56 against the device.

FIG. 5*b* shows a sitting user 57, driving a vehicle and using device 58, like the FIG. 1 device. The user is positioned behind the steering wheel 60. Drivers experience back pain, to be alleviated. The device 58 is held in place by the adjustable straps extending over the user's shoulders, to allow the user to control the amount of pressure on soft tissue 61.

In standing, laying down, sitting and all other positions, human and animal users can apply the adjustable cradling pressure of the invention to treat soft tissue trauma. Providing control of texture, pressure density, orientation, temperature, number of pressure elements and surface interface gives the present invention enhanced utility. The adjustable flexible elements provide an improved method to precisely control cradled pressure, in use, for treatment of soft tissues.

What is claimed is:

1. A therapeutic apparatus, the combination comprising a) adjustable therapeutic cushion means, b) flexible sheath means housing said cushion means, and having an hourglass configuration with a narrowed and sealed-off mid-region between two cradling and cushioning globular elements, c) elongated support means operatively connected to said sheath means for maneuvering said sheath means and cushion means into a selected position or positions for transmitting pressure between a person and a surface onto which a person's body weight is imposed via said cushion means and sheath means, d) wherein said cushion means defines two partially deformable, relatively stiff, resiliently compressible and cradle positioned globular elements, individually and independently shiftable in response to user pressure application, said globular elements being spaced apart, and said mid-region defines a sealed off zone having outwardly and oppositely facing concave surfaces between mid-portions of the globular elements, e) and wherein the sheath means defines a sheath extending about and spaced from said globular elements, allowing the globular elements to relatively twist, the sheath having a periphery extending circularly about at least half of each globular element and spaced from each globular element to merge with said mid-region, thereby to define a cradle shape, f) and an outer housing that is elongated, and surrounds the sheath means, the housing being elongated and having convex ends to provide said mid region with flexibility and element shiftability; and there being support straps sidewardly connected to the housing, proximate said convex ends, said straps having elongation substantially exceeding overall length of the housing.

2. The combination of claim 1 wherein said mid-region has an hourglass shape between the globular elements, with a minimum width less than the diameter of each element.

3. The combination of claim 2 wherein a sheath is endwise spaced from said globular elements, allowing the globular elements to relatively twist, individually.

4. The combination of claim 2 wherein said globular elements include enclosures filled with flowable material.

5. The combination of claim 1 wherein said straps are relatively narrow and operatively connected to opposite ends of said outer flexible housing, which is elongated between said ends, of said outer flexible housing.

6. The combination of claim 1 wherein one of the following is present:

i) said sheath means consists of durable fabric, ii) faux fur covers said sheath means.

7. The apparatus of claim 1 including indicia on dual straps for controlling angularity of the sheath means when supported.

8. The combination of claim 1 wherein the straps extend toward the respective elements.

9. The combination of claim 1 including indicia on the strap means to indicate positioning of the apparatus, when the elongated strap means extends over the user's shoulders and the sheath means dangles at the user's back below the user's neck.

10. The apparatus of claim 2, including an access opening through the sheath means via which at least one of said globular elements can be removed and/or replaced.

11. The apparatus of claim 2 wherein the globular elements are of different overall sizes.

12. The apparatus of claim 2 including vibration inducing means associated with at least one of said globular elements.

13. The apparatus of claim 1 wherein said elongated support means is generally hook shaped.

14. The method of using the apparatus of claim 8 which includes the steps:

i) positioning said sheath means in cradling relation adjacent the human body, by manipulation of said strap means, ii) allowing pressure exerted by the body to be transmitted via said sheath means and cushion means to a support surface, thereby locally and controllably pressurizing and deforming the body, by cradled pressure exertion.

15. The method of claim 14 which includes iii) periodically adjusting the position of the sheath means relative to the body.

16. The method of claim 14 which includes selecting and deploying relatively different size dual cushion means, and in spaced apart relation, to create cradle pressure exertion.

* * * * *